US009324266B2

(12) United States Patent
Hwang et al.

(10) Patent No.: US 9,324,266 B2
(45) Date of Patent: Apr. 26, 2016

(54) PIXEL AND ORGANIC LIGHT EMITTING DISPLAY USING THE SAME

(71) Applicant: Samsung Display Co., Ltd., Yongin, Gyeonggi-Do (KR)

(72) Inventors: Young-In Hwang, Yongin (KR); Jung-Mi Choi, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 233 days.

(21) Appl. No.: 13/890,679

(22) Filed: May 9, 2013

(65) Prior Publication Data

US 2014/0176520 A1 Jun. 26, 2014

(30) Foreign Application Priority Data

Dec. 21, 2012 (KR) ..... 10-2012-0150824

(51) Int. Cl.

| | |
|---|---|
| ***G09G 5/00*** | (2006.01) |
| ***G09G 3/32*** | (2006.01) |
| ***G09G 3/00*** | (2006.01) |

(52) U.S. Cl.

CPC ..... *G09G 3/3233* (2013.01); *G09G 3/003* (2013.01); *G09G 2300/043* (2013.01); *G09G 2300/0819* (2013.01); *G09G 2300/0852* (2013.01); *G09G 2320/045* (2013.01)

(58) Field of Classification Search

CPC ..... G09G 3/3225–3/3291; G09G 2300/0852; G09G 2300/0819; G09G 2300/043; G09G 2320/045

See application file for complete search history.

(56) References Cited

U.S. PATENT DOCUMENTS

| | | | | |
|---|---|---|---|---|
| 2003/0067424 | A1* | 4/2003 | Akimoto et al. | 345/55 |
| 2005/0017934 | A1 | 1/2005 | Chung et al. | |
| 2005/0140605 | A1* | 6/2005 | Jung | G09G 3/3233 345/76 |
| 2005/0156829 | A1* | 7/2005 | Choi | G09G 3/3233 345/76 |
| 2006/0055336 | A1* | 3/2006 | Jeong | 315/169.3 |
| 2009/0225011 | A1* | 9/2009 | Choi | 345/77 |
| 2009/0225012 | A1* | 9/2009 | Choi | 345/80 |
| 2009/0309516 | A1* | 12/2009 | Kim | 315/307 |
| 2010/0033409 | A1* | 2/2010 | Park | 345/76 |
| 2010/0177024 | A1* | 7/2010 | Choi | G09G 3/3233 345/76 |
| 2011/0164015 | A1* | 7/2011 | Kim | 345/211 |
| 2012/0019498 | A1* | 1/2012 | Jeong | 345/211 |
| 2012/0105495 | A1* | 5/2012 | Choi | 345/690 |
| 2012/0113077 | A1* | 5/2012 | Kang | 345/211 |
| 2013/0113779 | A1* | 5/2013 | Yoon | G09G 3/3233 345/212 |
| 2013/0249883 | A1* | 9/2013 | Hwang | 345/212 |
| 2014/0062331 | A1* | 3/2014 | Nam et al. | 315/226 |
| 2014/0333600 | A1* | 11/2014 | Lee et al. | 345/212 |
| 2014/0375705 | A1* | 12/2014 | Nathan | G09G 3/3233 345/694 |

FOREIGN PATENT DOCUMENTS

| | | |
|---|---|---|
| KR | 10-2005-0005646 | 1/2005 |
| KR | 10-2012-0044503 | 5/2012 |
| KR | 10-2012-0048294 | 5/2012 |

* cited by examiner

*Primary Examiner* — Amare Mengistu
*Assistant Examiner* — Crystal A Mathews
(74) *Attorney, Agent, or Firm* — Robert E. Bushnell, Esq.

(57) ABSTRACT

A pixel capable of being driven at a low driving frequency that includes an organic light emitting diode (OLED), a first transistor for controlling an amount of current supplied from a first power supply coupled to a first electrode thereof to the OLED to correspond to a voltage applied to a first node, a second transistor coupled between a data line and a second node and turned on when a scan signal is supplied to a scan line, a third transistor coupled between the first node and the second node and turned on when a second control signal is supplied to a second control line, a first capacitor coupled between the second node and a fixed voltage source, and a second capacitor and a third capacitor serially coupled between the first node and the first power supply.

38 Claims, 6 Drawing Sheets

PIXEL AND ORGANIC LIGHT EMITTING DISPLAY USING THE SAME

CLAIM PRIORITY

This application makes reference to, incorporates the same herein, and claims all benefits accruing under 35 U.S.C. §119 from an application earlier filed in the Korean Intellectual Property Office on 21 Dec. 2012 and there duly assigned Serial No. 10-2012-0150824.

BACKGROUND OF THE INVENTION

1. Field of the Invention

The present invention generally relates to a pixel and an organic light emitting display.

2. Description of the Related Art

Recently, various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting displays.

The above information disclosed in this Related Art section is only for enhancement of understanding of the background of the invention and therefore it may contain information that does not form the prior art that is already known to a person of ordinary skill in the art.

SUMMARY OF THE INVENTION

Accordingly, the present invention has been made to provide a pixel capable of being driven at a low driving frequency and an organic light emitting display using the same.

In order to achieve the foregoing and/or other aspects of the present invention, there is provided a pixel, including an organic light emitting diode (OLED), a first transistor for controlling an amount of current supplied from a first power supply coupled to a first electrode thereof to the OLED to correspond to a voltage applied to a first node, a second transistor coupled between a data line and a second node and turned on when a scan signal is supplied to a scan line, a third transistor coupled between the first node and the second node and turned on when a second control signal is supplied to a second control line, a first capacitor coupled between the second node and a fixed voltage source, and a second capacitor and a third capacitor serially coupled between the first node and the first power supply.

A common node of the second capacitor and the third capacitor is coupled to a first electrode of the first transistor. The pixel further includes a fourth transistor coupled between the data line and the first node and turned on when a first control signal is supplied to a first control line and a fifth transistor coupled between the fixed voltage source and a second electrode of the first transistor and turned on when the first control signal is supplied. The pixel further includes a sixth transistor coupled between the first power supply and the third node and turned off when an emission control signal is supplied to an emission control line and turned on in the other cases and a seventh transistor coupled between the second electrode of the first transistor and an anode electrode of the OLED and simultaneously turned on and off with the sixth transistor.

There is provided an organic light emitting display, including pixels positioned in regions divided by scan lines and data lines, a scan driver for supplying scan signals to the scan lines and for supplying an emission control signal to an emission control line commonly coupled to the pixels, a data driver for supplying data signals to the data lines in synchronization with the scan signals, and a control driver for supplying a first control signal to a first control line commonly coupled to the pixels and for supplying a second control signal to a second control line commonly coupled to the pixels. Each of the pixels positioned in an ith (i is a natural number) horizontal line includes an organic light emitting diode (OLED), a first transistor for controlling an amount of current supplied from a first power supply coupled to a first electrode thereof to the OLED to correspond to a voltage applied to a first node, a second transistor coupled between a data line and a second node and turned on when a scan signal is supplied to an ith scan line, a third transistor coupled between the first node and the second node and turned on when the second control signal is supplied, a first capacitor coupled between the second node and a fixed voltage source, and a second capacitor and a third capacitor serially coupled between the first node and the first power supply.

One frame period is divided into a first period, a second period, a third period, and a fourth period. The first control signal is supplied in the first period and the second period. The second control signal is supplied in the third period. The scan driver sequentially supplies scan signals to scan lines in the fourth period. The data driver supplies an off power supply in the first period and supplies a voltage of a reference power supply in the second period. The off power supply is set to have a voltage at which the first transistor may be turned off. The reference power supply is set so that current may flow through the first transistor. The data driver supplies a reference power supply so that current may flow through the first transistor in the first period and the second period. The scan driver supplies the emission control signal to the emission control line in the second period and the third period. The scan driver supplies the emission control signal to the emission control line in the first period.

In the pixel according to the present invention and the organic light emitting display using the same, the data signals may be charged at the moment when the pixels emit light so that the organic light emitting display may realize a 3D image while being driven at a low driving frequency. In addition, according to the present invention, before the data signals are supplied, a bias voltage is supplied to a gate electrode of a driving transistor included in each of the pixels so that a uniform image may be displayed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
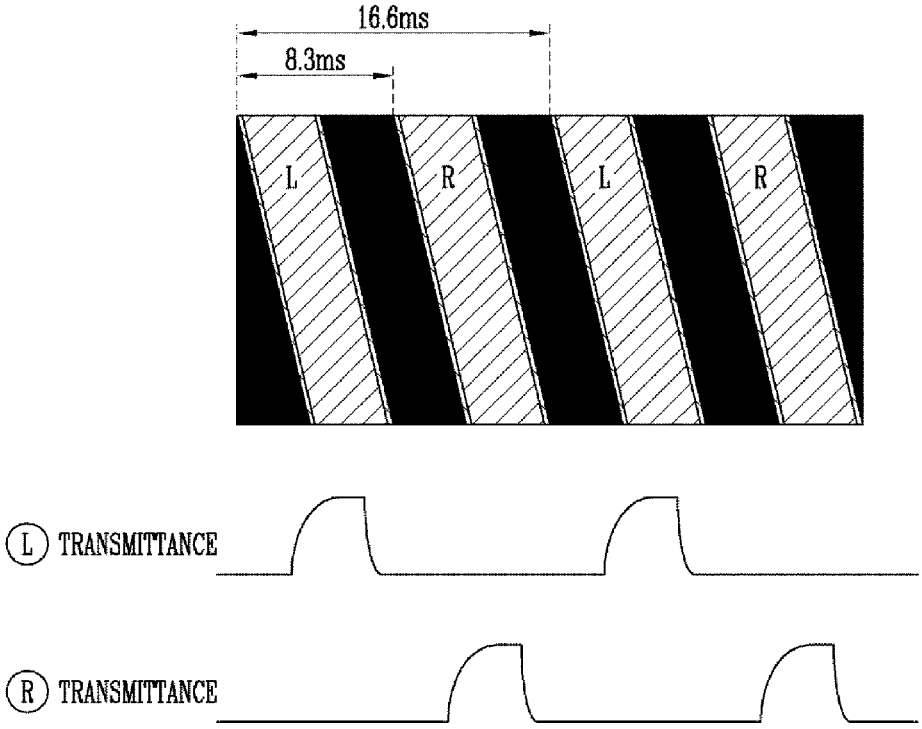
FIG. 1 (PRIOR ART)
FIG. 1 is a view illustrating a conventional frame period for 3D driving.

The example embodiments are described more fully hereinafter with reference to the accompanying drawings. The inventive concept may, however, be embodied in many different forms and should not be construed as limited to the example embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the inventive concept. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Among the FPDs, the organic light emitting displays display images using organic light emitting diodes (OLED) that generate light by re-combination of electrons and holes. The organic light emitting display has high response speed and is driven with low power consumption.

The organic light emitting display may include a plurality of pixels arranged at intersections of a plurality of data lines, scan lines, and power supply lines in a matrix. Each of the pixels commonly includes an organic light emitting diode (OLED), at least two transistors including a driving transistor, and at least one capacitor.

The organic light emitting display includes four frames in a period of 16.6 ms as illustrated in FIG. 1 in order to realize a 3D image. Among the four frames, a first frame displays a left image and a third frame displays a right image. Black images are displayed in a second frame and a fourth frame.

Shutter glasses receive light by a left lens in the first frame and receive light by a right lens in the third frame. At this time, a person who wears the shutter glasses recognizes an image supplied through the shutter glasses as a 3D image. The black images displayed in the second frame and the fourth frame prevents left and right images from being mixed with each other to prevent a crosstalk phenomenon from being generated.

However, in the conventional art, the four frames are included in a period of 16.6 ms so that the organic light emitting display must be driven at the driving frequency of 240 Hz. When the organic light emitting display is driven at a high frequency, power consumption increases, stability deteriorates, and manufacturing cost increases.

Hereinafter, a pixel and an organic light emitting display using the same will be described in detail as follows with reference to FIGS. 2 to 9 in which preferred embodiments by which those who skilled in the art may easily perform the present invention are included.

Figure 2:
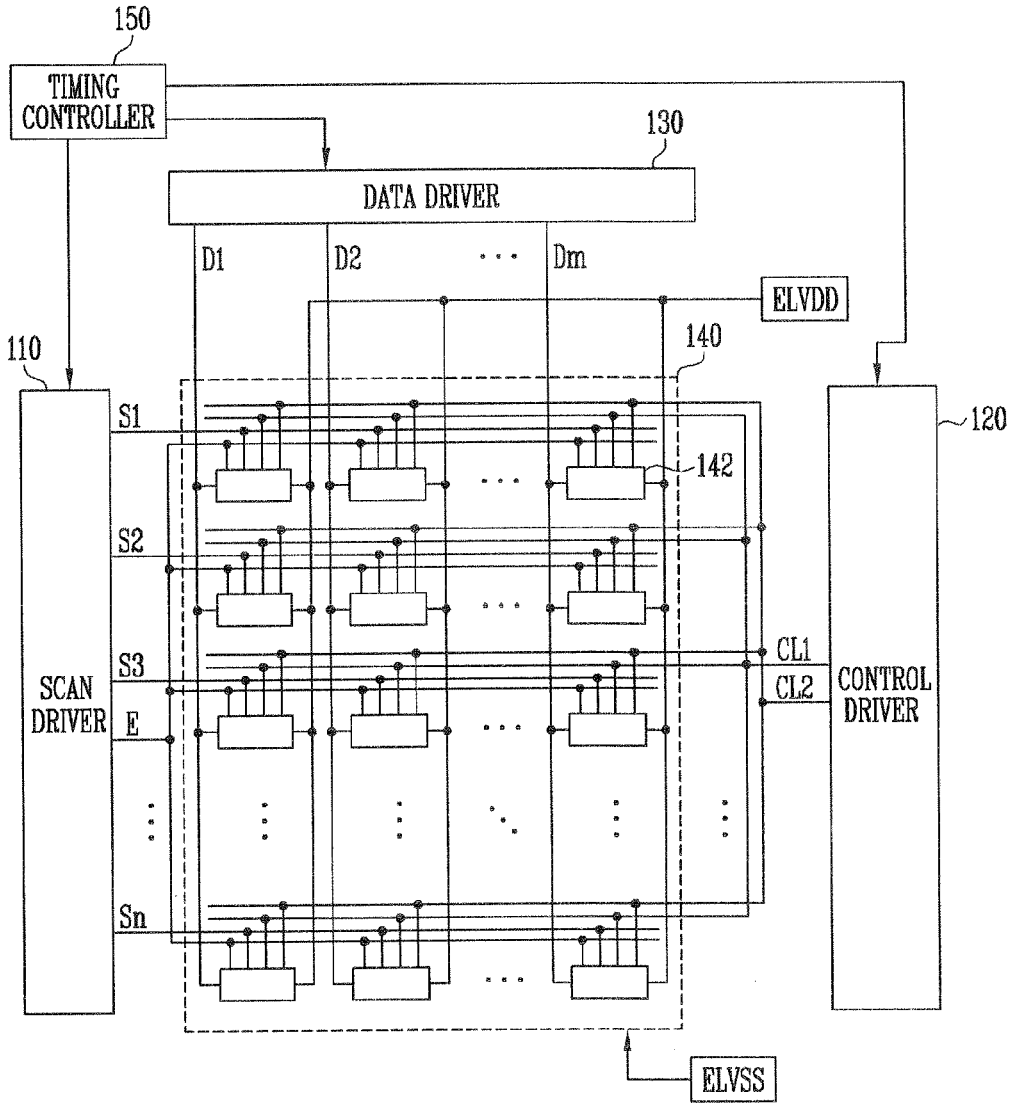
FIG. 2 is a view illustrating an organic light emitting display according to an embodiment of the present invention.

FIG. 2 is a view illustrating an organic light emitting display according to an embodiment of the present invention.

Referring to FIG. 2, the organic light emitting display according to the embodiment of the present invention includes a pixel unit 140 including pixels 142 positioned at the intersections of scan lines S1 to Sn and data lines D1 to Dm, a scan driver 110 for driving the scan lines S1 to Sn and an emission control line E, a control driver 120 for driving a first control line CL1 and a second control line CL2, a data driver 130 for driving the data lines D1 to Dm, and a timing controller 150 for controlling the drivers 110, 120, and 130.

Figure 4:
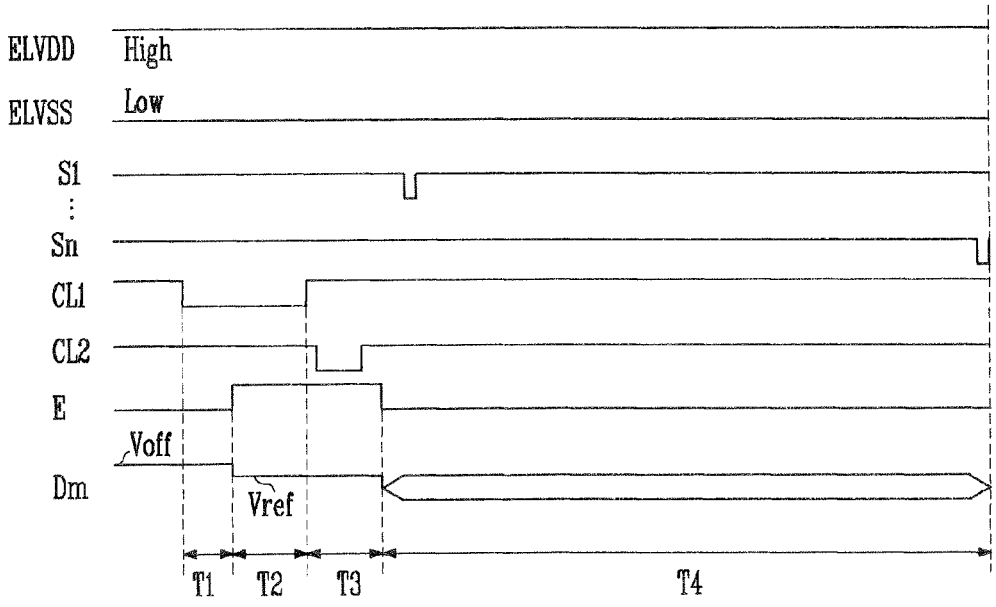
FIG. 4 is a waveform diagram illustrating a method of driving the pixel illustrated in FIG. 3 according to a first embodiment.

The scan driver 110 sequentially supplies scan signals to the scan lines S1 to Sn in a partial period of a frame period, for example, in a fourth period T4 as illustrated in FIG. 4. When the scan signals are sequentially supplied to the scan lines S1 to Sn, the pixels 142 are selected in units of horizontal lines. In addition, the scan driver 110 supplies an emission control signal to the emission control line E commonly coupled to the pixels 142. The emission control signal may be supplied in the remaining periods excluding the fourth period T4. On the other hand, the scan signals supplied by the scan driver 110 are set to have a voltage (for example, a low voltage) at which the transistors included in the pixels 142 are turned on and the emission control signal may be set to have a voltage (for example, a high voltage) at which the transistors are turned off.

The data driver 130 supplies data signals to the data lines D1 to Dm in synchronization with the scan signals in the fourth period T4. Then, the data signals are supplied to the pixels 142 selected by the scan signals. Then, the data driver 130 supplies a reference voltage Vref in the remaining periods excluding the fourth period T4, which will be described later in detail.

On the other hand, according to the present invention, the data driver 130 may alternately supply left data signals and right data signals every frame period. For example, the data driver 130 supplies right data signals in an ith frame period iF (i is a natural number) and supplies left data signals in an (i+1)th frame period i+1F. Here, the right data signals correspond to the right lens of shutter glasses and the left data signals correspond to the left lens of the shutter glasses.

The control driver 120 supplies a first control signal to the first control line CL1 commonly coupled to the pixels 142 and supplies a second control signal to the second control line CL2 commonly coupled to the pixels 142. Here, the first control signal and the second control signal are supplied not to overlap each other in the remaining periods excluding the fourth period T4.

The pixels 142 are positioned at the intersections of the scan lines S1 to Sn and the data lines D1 to Dm. Each of the pixels 142 generates light with predetermined brightness while controlling the amount of current that flows from a first power supply ELVDD to a second power supply ELVSS via an organic light emitting diode (OLED) (not shown) to correspond to each of the data signals. Here, in the ith frame period, the pixels 142 charge the right data signals and simultaneously generate light components corresponding to the left data signals. In the (i+1)th frame period, the pixels 142 charge the left data signals and simultaneously generate light components corresponding to the right data signals.

Figure 3:
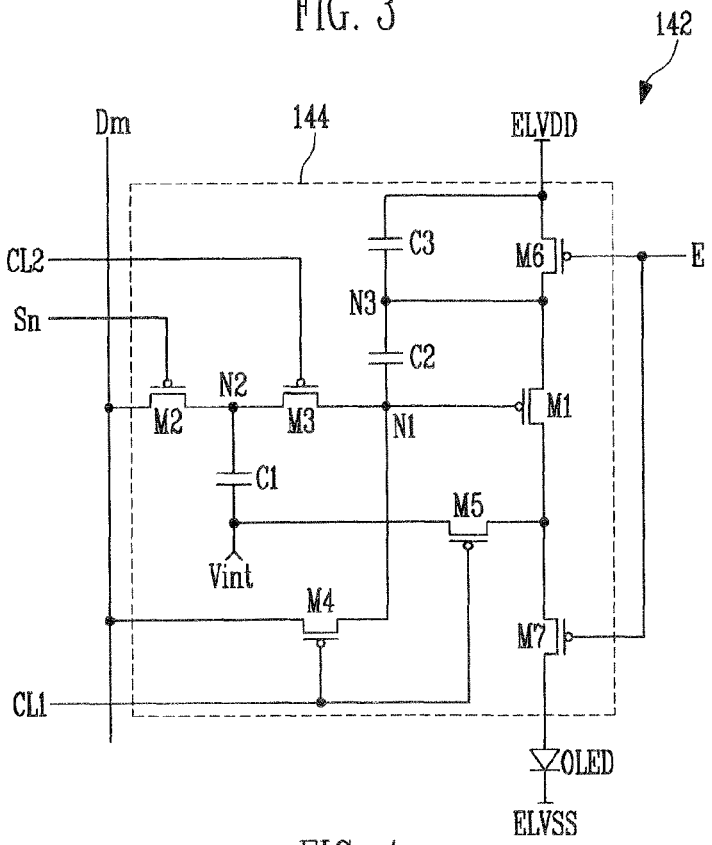
FIG. 3 is a view illustrating a first embodiment of the pixel illustrated in FIG. 2.

FIG. 3 is a view illustrating a first embodiment of the pixel illustrated in FIG. 2. In FIG. 3, for convenience sake, the pixel coupled to the nth scan line Sn and the mth data line Dm will be illustrated.

Referring to FIG. 3, a pixel 142 according to the first embodiment of the present invention includes an organic light emitting diode (OLED) and a pixel circuit 144 for controlling the amount of current supplied to the OLED.

The anode electrode of the OLED may be coupled to the pixel circuit 144 and the cathode electrode of the OLED may be coupled to a second power supply ELVSS. The OLED generates light with predetermined brightness to correspond to the amount of current supplied from the pixel circuit 144. On the other hand, the second power supply ELVSS may be set to have a lower voltage than that of a first power supply ELVDD so that current may flow through the OLED.

The pixel circuit 144 controls the amount of current supplied to the OLED to correspond to a data signal. For this purpose, the pixel circuit 144 includes first to seventh transistors M1 to M7 and first to third capacitors C1 to C3.

The first electrode of the first transistor M1 (the driving transistor) may be coupled to the second electrode of the sixth transistor M6 and the second electrode of the first transistor M1 may be coupled to the first electrode of the seventh transistor M7. The gate electrode of the first transistor M1 may be coupled to a first node N1. The first transistor M1 controls the amount of current that flows from the first power supply ELVDD to the second power supply ELVSS via the OLED to correspond to the voltage applied to the first node N1.

The first electrode of the second transistor M2 may be coupled to the data line Dm and the second electrode of the second transistor M2 may be coupled to a second node N2. The gate electrode of the second transistor M2 may be coupled to the scan line Sn. The second transistor M2 may be turned on when a scan signal is supplied to the scan line Sn to electrically couple the data line Dm and the second node N2 to each other.

The third transistor M3 may be coupled between the second node N2 and the first node N1. The gate electrode of the third transistor M3 may be coupled to the second control line CL2. The third transistor M3 may be turned on when the second control signal is supplied to the second control line CL2 to electrically couple the second node N2 and the first node N1 to each other.

The first electrode of the fourth transistor M4 may be coupled to the data line Dm and the second electrode of the fourth transistor M4 may be coupled to the first node N1. The gate electrode of the fourth transistor M4 may be coupled to the first control line CL1. The fourth transistor M4 may be turned on when the first control signal may be supplied to the first control line CL1 to electrically couple the data line Dm and the first node N1 to each other.

The first electrode of the fifth transistor M5 may be coupled to the second electrode of the first transistor M1 and the second electrode of the fifth transistor M5 may be coupled to an initializing power supply Vint (or a fixed voltage source). The gate electrode of the fifth transistor M5 may be coupled to the first control line CL1. The fifth transistor M5 may be turned on when the first control signal is supplied to the first control line CL1 to supply the voltage of the initializing power supply Vint to the second electrode of the first transistor M1. Here, the initializing power supply Vint may be set to have a low voltage so that the OLED may be turned off.

The first electrode of the sixth transistor M6 may be coupled to the first power supply ELVDD and the second electrode of the sixth transistor M6 may be coupled to the first electrode of the first transistor M1. The gate electrode of the sixth transistor M6 may be coupled to the emission control line E. The sixth transistor M6 may be turned off when the emission control signal is supplied to the emission control line E and may be turned on when the emission control signal is not supplied. When the sixth transistor M6 may be turned off, electric coupling between the first power supply ELVDD and the first transistor M1 is blocked.

The first electrode of the seventh transistor M7 may be coupled to the second electrode of the first transistor M1 and the second electrode of the seventh transistor M7 may be coupled to the anode electrode of the OLED. The gate electrode of the seventh transistor M7 may be coupled to the emission control line E. The seventh transistor M7 may be turned off when the emission control signal is supplied to the emission control line E and may be turned on when the emission control signal is not supplied. When the seventh transistor M7 may be turned off, electric coupling between the OLED and the first transistor M1 is blocked.

The first capacitor C1 may be coupled to a fixed voltage source, for example, between the initializing power supply Vint and the second node n2. The first capacitor C1 stores a voltage corresponding to the data signal in the fourth period T4.

The second capacitor C2 and the third capacitor C3 are serially coupled between the first node N1 and the first power supply ELVDD. A third node N3 that is a common node of the second capacitor C2 and the third capacitor C3 may be coupled to the first electrode of the first transistor M1. The second capacitor C2 and the third capacitor C3 charge voltages corresponding to the data signal and the threshold voltage of the first transistor M1.

FIG. 4 is a waveform diagram illustrating a method of driving the pixel illustrated in FIG. 3 according to a first embodiment.

Referring to FIG. 4, first, in a first period T1, the first control signal may be supplied to the first control line CL1 and the voltage of an off power supply Voff may be supplied to the data line Dm. When the first control signal is supplied to the first control line CL1, the fourth transistor M4 and the fifth transistor M5 are turned on. When the fifth transistor M5 is turned on, the second electrode of the first transistor M1 and the initializing power supply Vint are electrically coupled to each other. In this case, current supplied from the first transistor M1 may be supplied to the initializing power supply Vint so that the OLED may be set to be in a non-emission state.

When the fourth transistor M4 is turned on, the off power supply Voff from the data line Dm is supplied to the first node N1. Here, the voltage of the off power supply Voff may be set so that the first transistor M1 may be turned off so that an off bias voltage may be applied to the first transistor M1 in the first period T1. When the off bias voltage is applied to the first transistor M1 in the first period T1, the threshold voltage characteristic of the first transistor m1 may be initialized to an off bias state. When the characteristic of the first transistor M1 may be initialized before the data signal may be supplied, an image with desired brightness may be displayed regardless of the data signal supplied in a previous frame.

In a second period T2, supply of the first control signal to the first control line CL1 may be maintained and a reference power supply Vref may be simultaneously supplied to the data line Dm. Here, the reference power supply Vref may be set to have a voltage lower than the first power supply ELVDD and the off power supply Voff and higher than the initializing power supply Vint. For example, the reference power supply Vref may be set to have a voltage at which the current may flow through the first transistor M1. In the second period T2, the emission control signal may be supplied to the emission control line E.

When the emission control signal is supplied to the emission control line E, the sixth transistor M6 and the seventh transistor M7 are turned off. When the sixth transistor M6 may be turned off, electric coupling between the first transistor M1 and the first power supply ELVDD may be blocked. When the seventh transistor M7 is turned off, electric coupling between the first transistor M1 and the OLED may be blocked. Therefore, in the second period T2 and a third period T3 where the emission control signal may be supplied to the emission control line E, the OLED may be set to be in the non-emission state.

When the first control signal is supplied to the first control line CL1, the voltage of the reference power supply Vref from the data line Dm may be supplied to the first node N1. Then, the voltage of the third node N3 may be reduced from the voltage of the first power supply ELVDD to a voltage obtained by adding the voltage of the reference power supply Vref and the threshold voltage of the first transistor M1 to each other. When the voltage of the third node N3 is set as the voltage obtained by adding the voltage of the reference power supply Vref and the threshold voltage of the first transistor M1 to each other, the first transistor m1 may be turned off (off bias is applied). Here, when the voltage of the third node N3 is reduced, the current that flows from the first transistor M1 may be supplied to the initializing power supply Vint via the fifth transistor M5.

On the other hand, since the voltage of the third node N3 may be set as the voltage obtained by adding the voltage of the reference power supply Vref and the threshold voltage of the first transistor M1 to each other, in the second period T2, the voltage corresponding to the threshold voltage of the first transistor M1 may be charged in the second capacitor C2 and the third capacitor C3.

In the third period T3, supply of the emission control signal to the emission control line E may be maintained and the second control signal may be simultaneously supplied to the second control line CL2. When the second control signal is supplied to the second control line CL2, the third transistor M3 may be turned on. When the third transistor M3 is turned on, the second node N2 and the first node N1 are electrically coupled to each other. Then, a voltage charged in the first capacitor C1, that is, a voltage corresponding to the data signal may be supplied to the first node N1. At this time, a predetermined voltage may be charged in the second capacitor C2 and the third capacitor C3 to correspond to the voltage applied to the first node N1. Actually, in the third period T3, since the third node N3 may be set to be floated, the voltages corresponding to the threshold voltage of the first transistor M1 and the data signal are charged in the second capacitor C2 and the third capacitor C3.

For example, in the third period T3, the voltage illustrated in EQUATION 1 is applied to the first node N1 and the voltage illustrated in EQUATION 2 is applied to the third node N3.

$$V_{N1} = \frac{C1 \times V_{DATA} + \left(\frac{C2 \times C3}{C2 + C3}\right) \times Vref}{C1 + \frac{C2 \times C3}{C2 + C3}} \quad \text{[EQUATION 1]}$$

$$V_{N3} = Vref + Vth + \frac{C2}{C2 + C3} \times (V_{N1} - Vref) = \frac{C3}{C2 + C3} \times Vref + \frac{C2}{C2 + C3} \times V_{N1} \quad \text{[EQUATION 2]}$$

In EQUATION 1, a parasitic capacitor formed in the first transistor M1 may be not included. In EQUATION 1, Vdata means the voltage of the data signal. In EQUATION 2, Vth means the threshold voltage of the first transistor M1.

In the fourth period T4, the supply of the emission control signal to the emission control line E may be stopped. When the supply of the emission control signal to the emission control line E may be stopped, the first power supply ELVDD, the first transistor M1, the OLED, and the second power supply ELVSS are electrically coupled to each other. At this time, the first transistor M1 supplies predetermined current to the OLED to correspond to the voltage applied to the first node N1. For example, the first transistor M1 supplies the current illustrated in EQUATION 3 to the OLED.

$$I_{oled} = \beta(Vgs - Vth)^2 = \beta\left(\frac{C3}{C2 + C3} \times (V_{N1} - Vref)\right)^2 \quad \text{[EQUATION 3]}$$

In EQUATION 3, β means a constant value that reflects a process variation. Referring to EQUATION 3, in the fourth period T4, the first transistor M1 supplies predetermined current to the OLED to correspond to the data signal regardless of the threshold voltage of the first transistor M1. Then, the OLED generates light with predetermined brightness to correspond to the amount of current supplied thereto in the fourth period T4.

On the other hand, in the fourth period T4, the scan signals are sequentially supplied to the scan lines S1 to Sn. When the scan signals are sequentially supplied to the scan lines S1 to Sn, the second transistor M2 included in each of the pixels 142 may be turned on in units of horizontal lines. When the second transistor M2 is turned on, a data signal from a data line (one of D1 to Dm) may be supplied to the second node N2 included in each of the pixels 142. In this case, a voltage corresponding to the data signal may be charged in the first capacitor C1.

Figure 5:
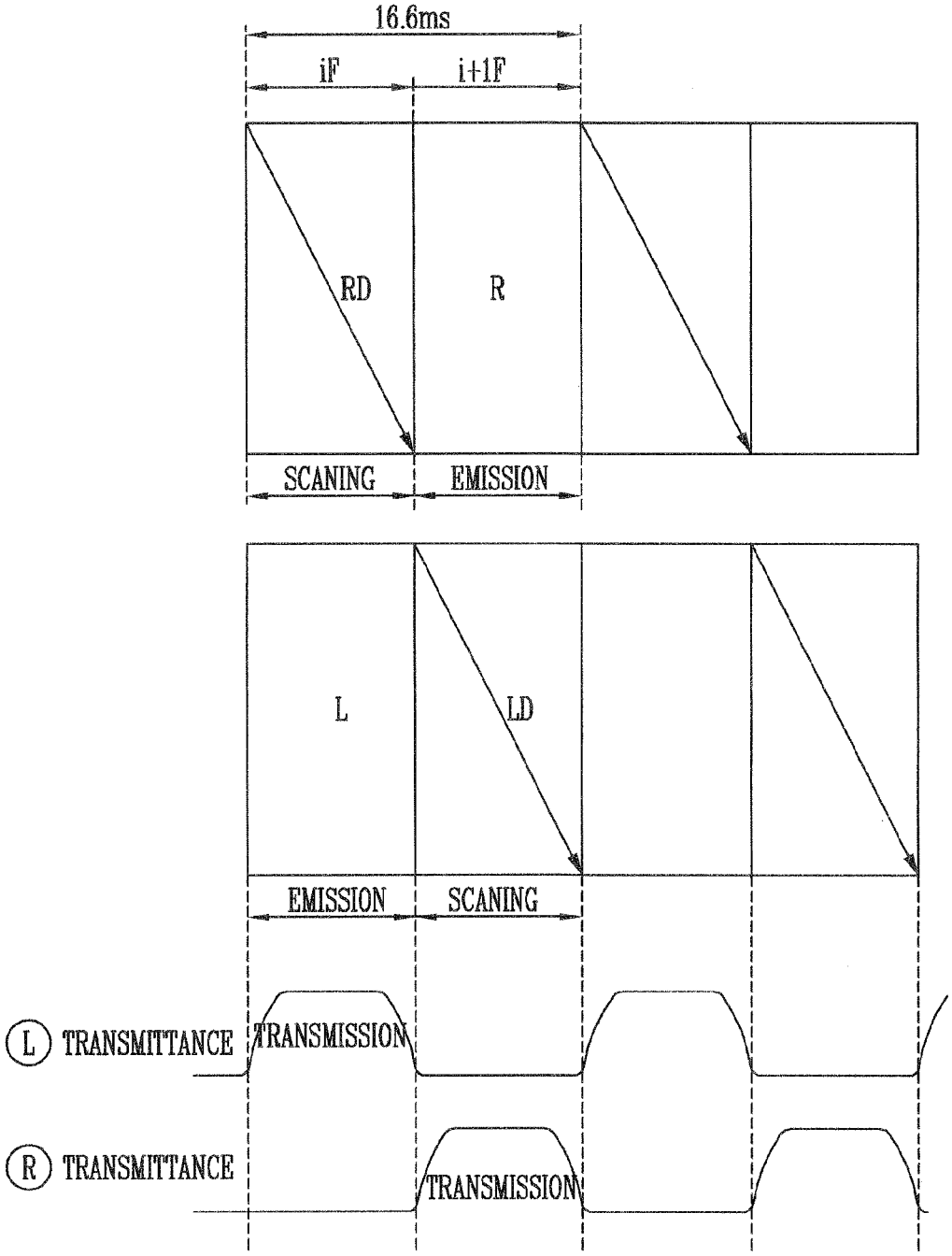
FIG. 5 is a view illustrating a frame period according to the present invention for 3D driving.

Actually, according to the present invention, the above-described processes are repeated to realize a predetermined image. On the other hand, according to the present invention, left and right data signals are alternately supplied in a frame period. In this case, the pixels 142 store voltages corresponding to right (or left) data signals in a period where images corresponding to left (or right) data signals are realized. Therefore, according to the present invention, as illustrated in FIG. 5, a 3D image may be realized at a driving frequency of 120 Hz as illustrated in FIG. 5. In FIG. 5, RD means a right data signal and LD means a left data signal. R means emission corresponding to the right data signal and L means emission corresponding to the left data signal.

Figure 6:
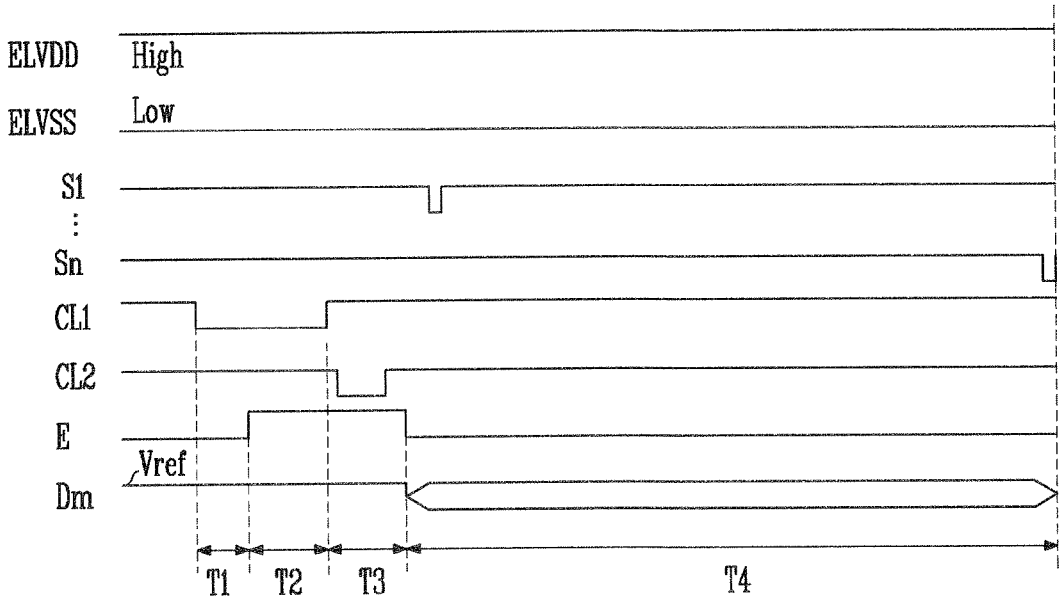
FIG. 6 is a waveform diagram illustrating a method of driving the pixel illustrated in FIG. 3 according to a second embodiment.

FIG. 6 is a waveform diagram illustrating a method of driving the pixel illustrated in FIG. 3 according to a second embodiment. In describing FIG. 6, description of the same elements as those of FIG. 4 will be omitted.

Referring to FIG. 6, in a driving waveform according to the second embodiment of the present invention, in the first period T1 and the second period T2, the reference power supply Vref may be supplied to the data line Dm. That is, an additional off power supply Voff is not supplied to the data line Dm.

When operation processes are described, in the first period T1, the first control signal may be supplied to the first control line CL1 and the voltage of the reference power supply Vref may be supplied to the data line Dm. When the first control signal is supplied to the first control line CL1, the fourth transistor M4 and the fifth transistor M5 are turned on. When the fifth transistor M5 is turned on, the second electrode of the first transistor M1 and the initializing power supply Vint are electrically coupled to each other.

When the fourth transistor M4 is turned on, the reference power supply Vref from the data line Dm may be supplied to the first node N1. Then, the threshold voltage characteristic of the first transistor m1 may be initialized by the voltage of the reference power supply Vref. Here, since the characteristics of all of the transistors M1 included in the pixel unit 140 are initialized by the voltage of the reference power supply Vref, an image with uniform brightness may be displayed regardless of the data signal supplied in a previous period. In the first period T1, current supplied via the first transistor M1 may be supplied to the initializing power supply Vint so that the OLED may be set to be in the non-emission state.

On the other hand, in the second embodiment of the present invention, since the remaining operation processes excluding that the reference power supply Vref may be supplied to the data line Dm in the first period T1 are the same as those of FIG. 4, detailed description will be omitted.

Figure 7:
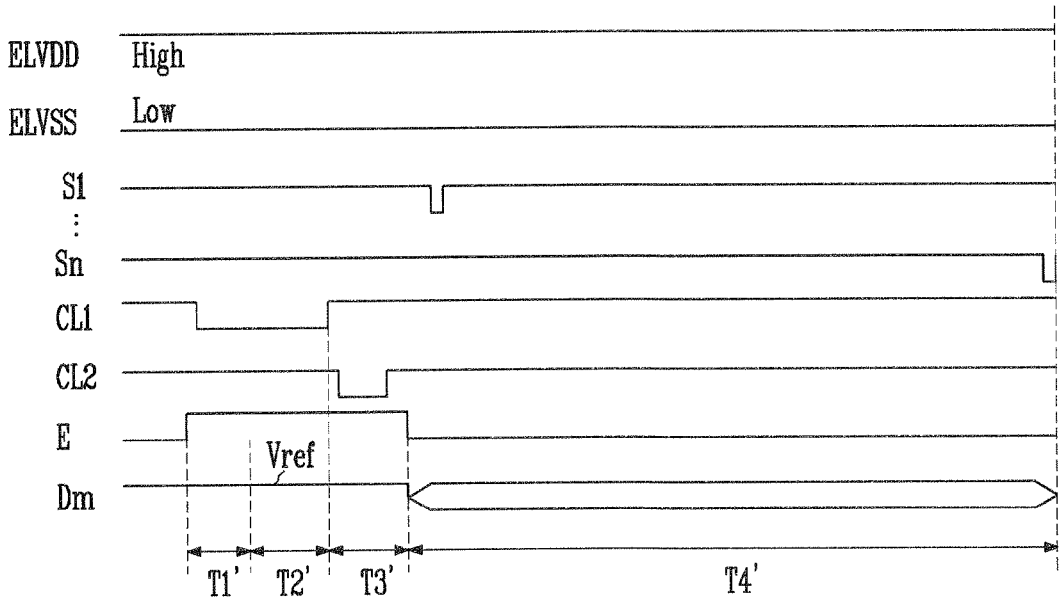
FIG. 7 is a waveform diagram illustrating a method of driving the pixel illustrated in FIG. 3 according to a third embodiment.

FIG. 7 is a waveform diagram illustrating a method of driving the pixel illustrated in FIG. 3 according to a third embodiment. In describing FIG. 7, description of the same elements as those of FIG. 4 will be omitted.

Referring to FIG. 7, in the third embodiment of the present invention, the emission control signal may be supplied to the emission control line E to overlap the first control signal and the second control signal. That is, in the first embodiment of FIG. 4, the emission control signal overlaps the first control signal in a partial period. However, in the third embodiment of the present invention, the emission control signal completely overlaps the first control signal. For this purpose, the emission control signal may be supplied to the emission control line E in a first period T1', a second period T2', and a third period T3'.

When the operation processes are described, first, in the first to third periods T1' to T3', the emission control signal may be supplied to the emission control line E. When the emission control signal may be supplied to the emission control line E, the sixth transistor M6 and the seventh transistor M7 are turned off so that the OLED may be set to be in the non-emission state.

Then, in the first period T1' and the second period T2', the first control signal may be supplied to the first control line CL1 so that the fourth transistor M4 and the fifth transistor M5 are turned on. When the fifth transistor M5 is turned on, the second electrode of the first transistor M1 and the initializing power supply Vint are electrically coupled to each other. When the fourth transistor M4 is turned on, the reference power supply Vref from the data line Dm may be supplied to the first node N1. When the voltage of the reference power supply Vref is supplied to the first node N1, the voltage of the third node N3 may be reduced to the voltage obtained by adding the voltage of the reference power supply Vref and the threshold voltage of the first transistor M1 to each other. Then, in the first period T1' and the second period T2', the voltage corresponding to the threshold voltage of the first transistor M1 may be charged in the second capacitor C2 and the third capacitor C3. Then, in the first period t1' and the second period T2', the threshold voltage of the first transistor M1 may be initialized to correspond to the reference power supply Vref. Actually, when the voltage of the third node N3 is reduced to the voltage obtained by adding the voltage of the reference power supply Vref and the threshold voltage of the first transistor M1 to each other, the first transistor M1 may be turned off so that the first transistor M1 may be initialized to an off bias state.

Then, in the third period T3', the second control signal may be supplied to the second control line CL2 so that the second node N2 and the first node N1 are electrically coupled to each other. Then, the voltage charged in the first capacitor C1 may be supplied to the first node N1 so that the voltages corresponding to the threshold voltage of the first transistor M1 and the data signal are charged in the second capacitor C2 and the third capacitor C3.

In the fourth period T4', the supply of the emission control signal to the emission control line E may be stopped so that the sixth transistor M6 and the seventh transistor M7 are turned on. When the sixth transistor M6 and the seventh transistor m7 are turned on, the first power supply ELVDD, the first transistor M1, the OLED, and the second power supply ELVSS are electrically coupled to each other. At this time, the first transistor M1 supplies predetermined current to the OLED to correspond to the voltage applied to the first node N1. Then, the voltage corresponding to the data signal may be charged in the first capacitor C1 to correspond to the scan signal supplied to the scan line Sn in the fourth period T4'.

Figure 8:
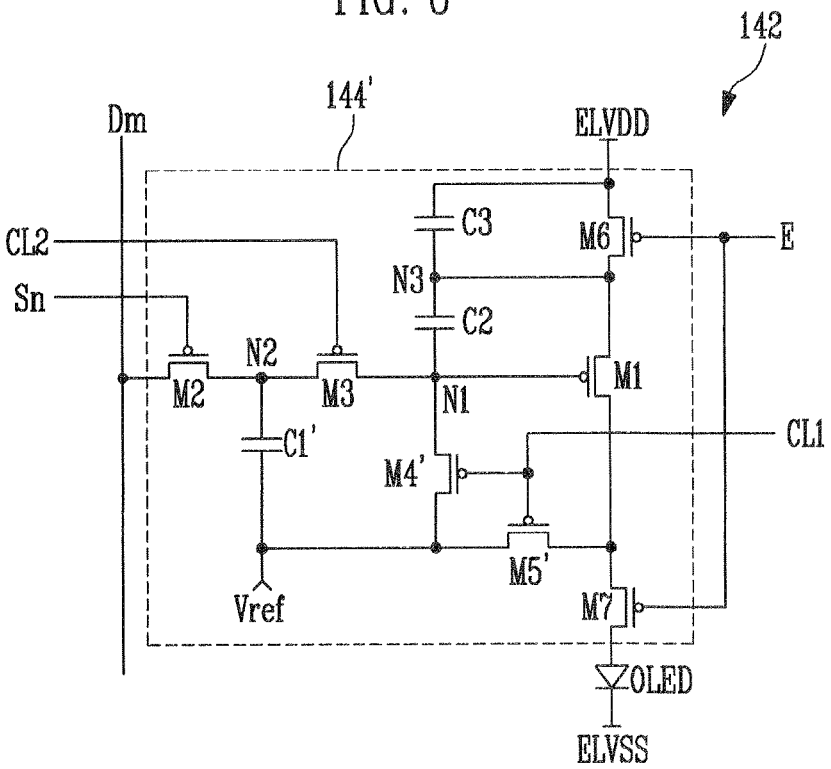
FIG. 8 is a view illustrating a second embodiment of the pixel illustrated in FIG. 2.

FIG. 8 is a view illustrating a second embodiment of the pixel illustrated in FIG. 2. In describing FIG. 8, the same elements as those of FIG. 3 are denoted by the same reference numerals and description thereof will be omitted.

Referring to FIG. 8, a pixel 142 according to the second embodiment of the present invention includes an organic light emitting diode (OLED) and a pixel circuit 144' for controlling the amount of current supplied to the OLED.

The anode electrode of the OLED may be coupled to the pixel circuit 144' and the cathode electrode of the OLED may be coupled to the second power supply ELVSS. The OLED generates light with predetermined brightness to correspond to the amount of current supplied from the pixel circuit 144'.

The pixel circuit 144' controls the amount of current supplied to the OLED to correspond to a data signal.

A first capacitor C1' included in the pixel circuit 144' may be coupled between a reference power supply Vref and a second node N2.

A fourth transistor M4' may be coupled between a first node N1 and the reference power supply Vref. The fourth transistor M4' supplies the voltage of the reference power supply Vref to the first node N1 when the first control signal may be supplied to the first control line CL1.

A fifth transistor M5' may be coupled between the reference power supply Vref and the second electrode of a first transistor M1. The fifth transistor m5' supplies the voltage of the reference power supply Vref to the second electrode of the first transistor M1 when the first control signal may be supplied to the first control line CL1. On the other hand, when the first control signal may be supplied to the first control line CL1, the fourth transistor M4' and the fifth transistor M5' are turned on so that the first transistor M1 may be diode coupled.

When the operation processes are described, the pixel according to the second embodiment of the present invention may be driven by the driving waveforms illustrated in FIGS. 4 and 7. In the second embodiment of the present invention, in the first to third periods T1 and T1' to T3 and T3', additional power supplies Vref and Voff are not supplied to the data line Dm.

First, when the pixel is driven by the driving waveform illustrated in FIG. 4, in the first period T1, the fourth transistor m4' and the fifth transistor M5' are turned on by the first control signal. When the fourth transistor M4' and the fifth transistor M5' are turned on, the first transistor M1 may be diode coupled. In this case, predetermined current flows from the first power supply ELVDD to the reference power supply Vref. Then, in the second period T2, the supply of the emission control signal to the emission control line E may be stopped so that a sixth transistor M6 and a seventh transistor M7 are turned off. In this case, the voltage of a third node N3 may be set as a voltage obtained by adding the voltage of the reference power supply Vref and the threshold voltage of the first transistor M1 to each other so that the voltage corresponding to the threshold voltage of the first transistor M1 may be charged in a second capacitor C2 and a third capacitor C3. Since the other operation processes are the same as those of the first embodiment of the present invention, description thereof will be omitted.

On the other hand, when the pixel may be driven by the driving waveform illustrated in FIG. 7, the sixth transistor M6 and the seventh transistor M7 are turned off to correspond to the emission control signal supplied to the emission control line E in the first to third periods T1' to T3'.

Then, the fourth transistor M4' and the fifth transistor M5' are turned on by the first control signal supplied in the first period T1' and the second period T2'. When the fourth transistor M4' and the fifth transistor M5' are turned on, the voltage of the reference power supply Vref may be supplied to the gate electrode of the first transistor M1 and the second electrode of the first transistor M1. Then, when the fourth transistor M4' and the fifth transistor M5' are turned on, the first transistor m1 may be diode coupled. In this case, the voltage of the third node N3 may be set as the voltage obtained by adding the voltage of the reference power supply Vref and the threshold voltage of the first transistor M1 to each other so that the voltage corresponding to the threshold voltage of the first transistor M1 may be charged in the second capacitor C2 and the third capacitor C3. Since the other operation processes are the same as those of the first embodiment, description thereof will be omitted.

Figure 9:
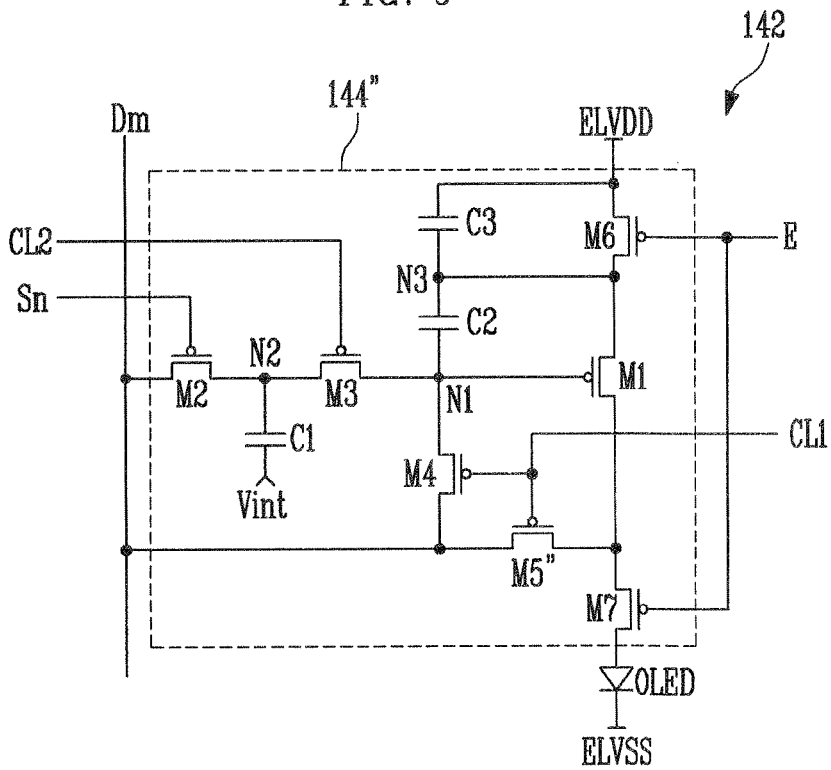
FIG. 9 is a view illustrating a third embodiment of the pixel illustrated in FIG. 2.

FIG. 9 is a view illustrating a third embodiment of the pixel illustrated in FIG. 2. In describing FIG. 9, the same elements as those of FIG. 3 are denoted by the same reference numerals and description thereof will be omitted.

Referring to FIG. 9, a pixel 142 according to the third embodiment of the present invention includes an organic light emitting diode (OLED) and a pixel circuit 144" for controlling the amount of current supplied to the OLED.

The anode electrode of the OLED may be coupled to the pixel circuit 144" and the cathode electrode of the OLED may be coupled to the second power supply ELVSS. The OLED generates light with predetermined brightness to correspond to the amount of current supplied from the pixel circuit 144".

The pixel circuit 144" controls the amount of current supplied to the OLED to correspond to a data signal.

A fifth transistor M5" included in the pixel circuit 144" may be coupled between the data line Dm and the second electrode of a first transistor M1. The fifth transistor M5" may be turned on when the first control signal may be supplied to the first control line CL1 to electrically couple the data line Dm and the second electrode of the first transistor M1 to each other.

When the operation processes are described with reference to the waveforms of FIGS. 7 and 9, first, a sixth transistor m6 and a seventh transistor M7 are turned off to correspond to the emission control signal supplied to the emission control line E in the first to third periods T1' to T3'.

The fourth transistor M4" and the fifth transistor M5" are turned on by the first control signal supplied in the first period T1' and the second period t2'. When the fourth transistor M4" and the fifth transistor M5" are turned on, the voltage of a reference power supply Vref may be supplied to the gate electrode of the first transistor M1 and the second electrode of the first transistor M1. When the fourth transistor M4" and the fifth transistor M5" are turned on, the first transistor M1 may be diode coupled.

In this case, the voltage of a third node N3 may be set as the voltage obtained by adding the voltage of the reference power supply Vref and the threshold voltage of the first transistor M1 to each other so that the voltage corresponding to the threshold voltage of the first transistor M1 may be charged in a second capacitor C2 and a third capacitor C3. Since the other operation processes are the same as those of the first embodiment of the present invention, description thereof will be omitted.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel, comprising:

an organic light emitting diode;

a first transistor controlling an amount of current supplied from a first power supply coupled to a first electrode of the first transistor to the OLED to correspond to a voltage applied to a first node directly coupled to a gate electrode of the first transistor;

a second transistor coupled between a data line and a second node and turned on when a scan signal is supplied to a scan line;

a third transistor coupled between the first node and the second node and turned on when a second control signal is supplied to a second control line;

a first capacitor coupled between the second node and a fixed voltage source; and a second capacitor and a third capacitor serially coupled between the first node and the first power supply.

2. The pixel as recited in claim 1, a third node between the second capacitor and the third capacitor being coupled to the first electrode of the first transistor.

3. The pixel as recited in claim 2, further comprising:

a fourth transistor coupled between the data line and the first node and turned on when a first control signal is supplied to a first control line; and a fifth transistor coupled between the fixed voltage source and a second electrode of the first transistor and turned on when the first control signal is supplied.

4. The pixel as recited in claim 3, a voltage value of the fixed voltage source being set to turn off the OLED.

5. The pixel as recited in claim 3, turn-on periods of the fourth transistor and the third transistor do not overlap.

6. The pixel as recited in claim 3, a turn-on period of the second transistor not overlapping the turn-on periods of the third transistor and the fourth transistor.

7. The pixel as recited in claim 3, further comprising:

a sixth transistor coupled between the first power supply and the third node and turned off when an emission control signal is supplied to an emission control line and turned on in the other cases; and a seventh transistor coupled between the second electrode of the first transistor and an anode electrode of the OLED and simultaneously turned on and off with the sixth transistor.

8. The pixel as recited in claim 7, a turn-on period of the sixth transistor not overlapping a turn-on period of the third transistor.

9. The pixel as recited in claim 7, a turn-on period of the sixth transistor not overlapping a turn-on period of the fourth transistor.

10. The pixel as recited in claim 7, the turn-on period of the sixth transistor partially overlapping the turn-on period of the fourth transistor.

11. The pixel as recited in claim 2, further comprising:

a fourth transistor coupled between the fixed voltage source and the first node and turned on when a first control signal is supplied to a first control line; and a fifth transistor coupled between the fixed voltage source and the second electrode of the first transistor and turned on when the first control signal is supplied.

12. The pixel as recited in claim 11, the fixed voltage source being set to have a lower voltage than that of the first power supply so that current flows through the first transistor.

13. The pixel as recited in claim 11, turn-on periods of the fourth transistor and the third transistor do not overlap.

14. The pixel as recited in claim 11, a turn-on period of the second transistor not overlapping the turn-on periods of the third transistor and the fourth transistor.

15. The pixel as recited in claim 11, further comprising:

a sixth transistor coupled between the first power supply and a third node and turned off when an emission control signal is supplied to an emission control line and turned on in the other cases; and a seventh transistor coupled between the second electrode of the first transistor and an anode electrode of the OLED and simultaneously turned on and off with the sixth transistor.

16. The pixel as recited in claim 15, a turn-on period of the sixth transistor not overlapping a turn-on period of the third transistor.

17. The pixel as recited in claim 15, a turn-on period of the sixth transistor not overlapping a turn-on period of the fourth transistor.

18. The pixel as recited in claim 15, the turn-on period of the sixth transistor partially overlapping the turn-on period of the fourth transistor.

19. The pixel as recited in claim 2, further comprising:

a fourth transistor coupled between the data line and the first node and turned on when a first control signal is supplied to a first control line; and a fifth transistor coupled between the data line and the second electrode of the first transistor and turned on when the first control signal is supplied.

20. The pixel as recited in claim 19, turn-on periods of the fourth transistor and the third transistor do not overlap.

21. The pixel as recited in claim 19, a turn-on period of the second transistor not overlapping the turn-on periods of the third transistor and the fourth transistor.

22. The pixel as recited in claim 19, further comprising:

a sixth transistor coupled between the first power supply and a third node and turned off when an emission control signal is supplied to an emission control line and turned on in the other cases; and a seventh transistor coupled between the second electrode of the first transistor and an anode electrode of the OLED and simultaneously turned on and off with the sixth transistor.

23. The pixel as recited in claim 22, a turn-on period of the sixth transistor not overlapping the turn-on period of the third transistor and the fourth transistor.

24. An organic light emitting display, comprising:

pixels positioned in regions divided by scan lines and data lines;

a scan driver supplying scan signals to the scan lines and supplying an emission control signal to an emission control line commonly coupled to the pixels;

a data driver supplying data signals to the data lines in synchronization with the scan signals; and a control driver supplying a first control signal to a first control line commonly coupled to the pixels and supplying a second control signal to a second control line commonly coupled to the pixels, each of the pixels positioned in an $i^{th}$ (i is a natural number) horizontal line comprising:

an organic light emitting diode (OLED);

a first transistor controlling an amount of current supplied from a first power supply coupled to a first electrode of the first transistor to the OLED to correspond to a voltage applied to a first node directly coupled to a gate electrode of the first transistor;

a second transistor coupled between a data line and a second node and turned on when a scan signal is supplied to an ith scan line;

a third transistor coupled between the first node and the second node and turned on when the second control signal is supplied;

a first capacitor coupled between the second node and a fixed voltage source; and a second capacitor and a third capacitor serially coupled between the first node and the first power supply.

25. The organic light emitting display as recited in claim 24, a third node between the second capacitor and the third capacitor being coupled to the first electrode of the first transistor.

26. The organic light emitting display as recited in claim 25, one frame period being divided into a first period, a second period, a third period, and a fourth period, the first control signal being supplied in the first period and the second period, and the second control signal being supplied in the third period.

27. The organic light emitting display as recited in claim 26, the scan driver sequentially supplying scan signals to scan lines in the fourth period.

28. The organic light emitting display as recited in claim 26, the data driver supplying an off power supply in the first period and supplying a voltage of a reference power supply in the second period.

29. The organic light emitting display as recited in claim 28, the off power supply being set to have a voltage at which the first transistor is turned off.

30. The organic light emitting display as recited in claim 28, the reference power supply being set so that current flows through the first transistor.

31. The organic light emitting display as recited in claim 26, the data driver supplying a reference power supply so that current flows through the first transistor in the first period and the second period.

32. The organic light emitting display as recited in claim 26, the scan driver supplying the emission control signal to the emission control line in the second period and the third period.

33. The organic light emitting display as recited in claim 32, the scan driver supplying the emission control signal to the emission control line in the first period.

34. The organic light emitting display as recited in claim 25, further comprising:

a fourth transistor coupled between the data line and the first node and turned on when the first control signal is supplied;

a fifth transistor coupled between the fixed voltage source and the second electrode of the first transistor and turned on when the first control signal is supplied;

a sixth transistor coupled between the first power supply and the third node and turned off when the emission control signal is supplied and turned on in the other cases; and a seventh transistor coupled between the second electrode of the first transistor and the anode electrode of the OLED and simultaneously turned on and off with the sixth transistor.

35. The organic light emitting display as recited in claim 34, a voltage value of the fixed voltage source being set to turn off the OLED.

36. The organic light emitting display as recited in claim 24, further comprising:

a fourth transistor coupled between the fixed voltage source and the first node and turned on when the first control signal is supplied;

a fifth transistor coupled between the fixed voltage source and the second electrode of the first transistor and turned on when the first control signal is supplied;

a sixth transistor coupled between the first power supply and the third node and turned off when the emission control signal is supplied and turned on in the other cases; and a seventh transistor coupled between the second electrode of the first transistor and the anode electrode of the OLED and simultaneously turned on and off with the sixth transistor.

37. The organic light emitting display as recited in claim 36, the fixed voltage source being set to have a lower voltage than that of the first power supply so that current flows through the first transistor.

38. The organic light emitting display as recited in claim 24, further comprising:

a fourth transistor coupled between the data line and the first node and turned on when the first control signal is supplied;

a fifth transistor coupled between the data line and the second electrode of the first transistor and turned on when the first control signal is supplied;

a sixth transistor coupled between the first power supply and a third node and turned off when the emission control signal is supplied and turned on in the other cases; and a seventh transistor coupled between the second electrode of the first transistor and the anode electrode of the OLED and simultaneously turned on and off with the sixth transistor.

* * * * *